United States Patent [19]

Fonas

[11] Patent Number: 4,726,509

[45] Date of Patent: Feb. 23, 1988

[54] GIFT WRAPPING

[76] Inventor: Kenneth R. Fonas, 814 Pittsburgh Ave., North Versailles, Pa. 15137

[21] Appl. No.: 818,655

[22] Filed: Jan. 13, 1986

[51] Int. Cl.[4] ..... B65D 5/00; D04D 7/10

[52] U.S. Cl. ..... 229/8; 28/147; 206/457; 229/922; 428/4; D9/334; D11/184

[58] Field of Search ..... 229/8, 922, 923, 87 R, 229/46, 52 AL, 48 R; 206/457, 597; D9/334; D11/184; 428/4, 5, 99; 223/46; 2/244–246; 28/147

[56] References Cited

U.S. PATENT DOCUMENTS

| | | | |
|---|---|---|---|
| 232,285 | 9/1880 | Manneck | 229/46 |
| 707,962 | 8/1902 | Feil | 229/46 |
| 1,029,371 | 6/1912 | Keighley | 2/245 |
| 1,366,153 | 1/1921 | Bangs | 2/245 |
| 1,690,850 | 11/1928 | Behrman | 229/46 |
| 1,792,572 | 2/1931 | Buswell | 229/8 |
| 2,114,860 | 4/1938 | Schmalz | 229/8 |
| 2,290,971 | 7/1942 | King | 229/52 A |
| 2,849,821 | 9/1958 | Doig | 41/10 |
| 3,010,236 | 11/1961 | Doig | 41/10 |
| 3,143,259 | 8/1964 | Paar | 428/5 |
| 3,305,161 | 2/1967 | Offer | 229/48 R |
| 3,973,356 | 8/1976 | Schacht | 229/46 |
| 4,238,070 | 12/1980 | Lyons | 229/87 R |
| 4,515,837 | 5/1985 | Cheng | 428/4 |

FOREIGN PATENT DOCUMENTS

| | | | |
|---|---|---|---|
| 8009680.6 | 5/1981 | Fed. Rep. of Germany . | |
| 1067431 | 1/1954 | France | 229/46 |

*Primary Examiner*—Stephen Marcus
*Assistant Examiner*—Gary E. Elkins
*Attorney, Agent, or Firm*—Hymen Diamond

[57] ABSTRACT

A gift-wrapping assembly including a box having elongated slots in the top. Each slot is partially cut out from the top with a portion of the top partially removed, the cut out portion being hinged on the uncut portion and forming a tongue to hold tabs inserted in the slots. The assembly also includes a plurality of decorative ribbons, each having a plastic plate at each end. A tab extends as a partial cut-out from each end of each plate at approximately a right angle to the plane of the plate. At its junction with the plate the tab is undercut. Each ribbon encircles the box and is locked by the engagement at its ends of the undercut edges of the tabs in the outer regions of the corners of the opposite slots of each pair. The assembly also includes a bow having on its under side a plate from whose corners tabs extend at approximately a right angle to the plane of the plate. These tabs are also undercut. The bow is locked on the box by engagement of the undercuts of each tab with the outer regions of the corners of the slots. The tabs of the bow overlay the tabs of the ribbons.

17 Claims, 10 Drawing Figures

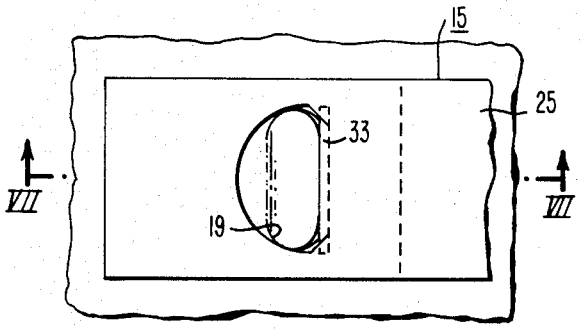
FIG.6
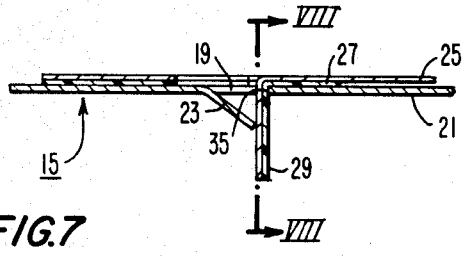
FIG.7
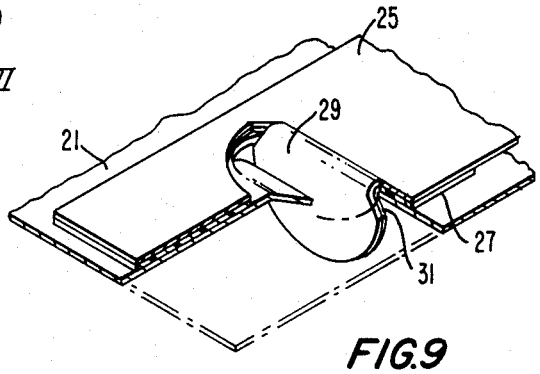
FIG.9
FIG.2
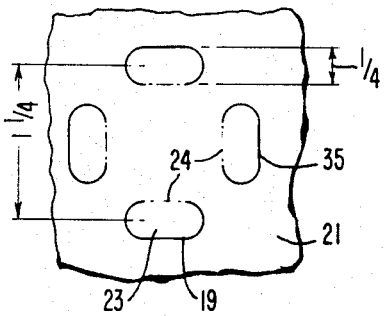
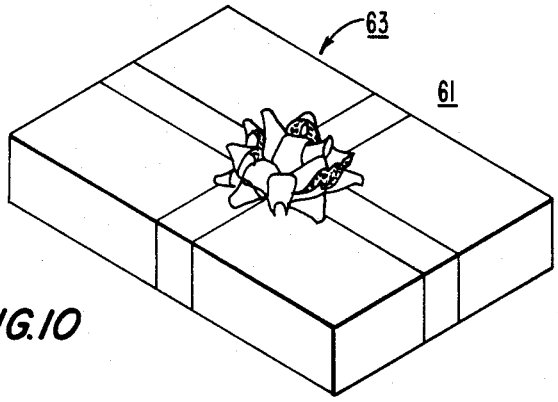
FIG.10

GIFT WRAPPING

REFERENCE TO RELATED APPLICATION

Application Ser. No. 732,729 filed May 10, 1985 to Kenneth Fonas, aka Kenneth Robert Fonas, for GIFT WRAP BOX is incorporated herein by reference.

BACKGROUND OF THE INVENTION

This invention relates to gift-wrapping assemblies and has particular relationship to assemblies which are appealingly or even artistically decorated by ribbons and bows, rosettes or pompoms. Where the words "bows" alone is used in this application, it is intended to mean bows, rosettes or pompoms or other ornamentation. Such assemblies in accordance with the teachings of the most common prior art are produced by manually wrapping a ribbon around the gift-wrapping package. Typically, the package includes a box wrapped with decorative paper. It has also been prior-art practice to prefabricate the bow and attach it in one way or another to a ribbon which is wrapped around the package, or the bow is directly adhered to the package which may or may not have the ribbon wrapped around it. The manual practice just described must be carried out skillfully to achieve attractive appearance and even if skill is exercised in forming a gift-wrapping assembly, the ultimate desired appearance may not be achieved. The practice involving a prefabricated bow involves difficulty in mounting the bow on, or securing the bow to, the package.

It is an object of this invention to overcome the deficiencies of the prior art and to provide a gift-wrapping assembly that shall be capable of being readily produced and that shall have a highly attractive appearance.

SUMMARY OF THE INVENTION

In accordance with this invention a gift-wrapping assembly is provided which includes a box for containing the gift, a decorative ribbon unit and a bow unit. The ribbon unit and the bow unit are separate items. The box, ribbon unit and bow unit are constructed so that the ribbon and a bow, rosette or pompom may each be readily mounted on, and secured to, the box separately but cooperatively to complete a highly attractive gift-wrapping assembly. The structures of the box, ribbon unit and bow unit are such that the assembly may be produced by an unskilled person.

Typically, the box is composed of cardboard or like sheet material and formed, as disclosed in Fonas application '729, from a blank. The outer surface of the blank is decorative. For example, the surface may be gilded or of an attractive color, or a decorative design may be printed on the outer surface. The box may be formed of sheet material of the same color or texture throughout laminated with decorative wrapping paper. The box may have any desired shape; for example, it may be a rectangular parallelapiped, or a cylinder with circular, oval or elliptical bases. The box differs from the box in Fonas application in having a slot or slots in one of its walls, typically the top. There are typically at least two parallel elongated oppositely disposed slots. In describing the boundaries of the parallel slots, the direction towards the region between the slots will be referred to as "inward" and the direction away from the region between the slots will be described as "outward". Typically, the slots are cut into the top 12 of the box shown in FIG. 6, or top 52 of FIG. 12, of Fonas application.

Each slot is partially, or totally, die cut out of the wall. Where the slot is partially cut out, the part of the wall which is cut out is initially flush with the top of the box and is hinged to the wall at a junction between this cut-out part and the wall; i.e., the die cut initially produces a slit defining the slot. The hinged part, when turned downwardly into the box to form the slot, may be described as a tongue extending downwardly into the box.

The ribbon is of decorative texture. Plates or strips of a resilient plastic material, or the like, are secured or adhered to the ribbon near its ends. Tabs are knocked out of the ribbon and of the plates and the ribbon where the plates are adhered to the ribbon. Each tab is undercut in the region where it joins the plate. To form the tabs, the shape of the tabs are die cut into the material. The undercut is generated on folding of the die cut portion to form the tab. The undercut portion of the tab is of linear or arcuate contour. If the ribbon is of stiff material, the plates may be dispensed with and the tabs knocked out of the ends of the stiff ribbon.

In forming the gift-wrapping assembly according to this invention, each tab is engaged, along its junction with the plate, with an outward boundary of an associated slot with the corners of the slot engaged or latched in the V formed between the undercut edge and the contiguous portion of the plate. The distance along the ribbon between the junctions of the tabs and their plates is such that the ribbon is wrapped tightly around the box so that the ribbon exerts tension to pull each tab against the boundary with which it is engaged. The ribbon is thus locked tightly into the slots. Typically, the wall of the box has two pairs of slots whose transverse axes are at right angles to each other so that the assembly is decorated by two crossed ribbons. There may be more than two pairs of slots and ribbons, particularly where the box is cylindrical.

The bow unit is prefabricated. It includes a bow, rosette or pompom with a plate or sheet of resilient plastic secured to the bottom by a staple or by an adhesive. Tabs which are undercut extend from the periphery of the plate. Typically, there are pairs of oppositely disposed pairs of tabs. In forming; i.e., completing the gift-wrapping assembly, the bow unit is mounted on the box, over the tabs of the ribbon units with the tabs of each pair latched into corresponding oppositely disposed slots overlapping the corresponding tabs of the ribbon. The junctions of the tabs of each pair are spaced approximately equally to the spacing between the outer boundaries of the slots into which the tabs are to be latched. Once each tab is latched into a slot, it is held by the tongues which extend from the opposite boundary of the slot where the slots are partially cut out and have tongues. A highly attractive gift-wrapping assembly is thus produced without exercise of unusual skill. The assembly as described above including cross ribbons and a bow, rosette or pompom has unique advantages particularly as to attractiveness. An assembly including a bow alone secured to the box by one or more tabs in a slot or slots is within the scope of equivalents of this invention. In this case, decorative bands simulating crossed ribbons may be printed on the box.

BRIEF DESCRIPTION OF THE DRAWINGS

For a better understanding of this invention, both as to its organization and as to its method of operation, together with additional objects and advantages thereof, reference is made to the following description, taken in connection with the accompanying drawings, in which:

FIG. 2 is a fragmental plan view of the top of the box of the assembly shown in FIG. 1;

FIG. 6 is a fragmental plan view of the top of an assembly as shown in FIG. 1 showing the manner in which a ribbon is latched into a slot in the practice of this invention;

FIG. 7 is a view in section taken along line VII—VII of FIG. 6;

FIG. 9 is a fragmental view in isometric also showing the manner in which a tab is latched into a slot in the box; and FIG. 10 is a view in isometric showing a modification of this invention.

FIGS. 2, 3 and 4 show dimensions (in inches) of significant parts of an assembly constructed in the practice of this invention and found to function satisfactorily. These dimensions are shown for the purpose of aiding those skilled in the art in practicing this invention and not with any intention of in any way limiting the scope of this invention.

DETAILED DESCRIPTION OF EMBODIMENTS

Figure 1:
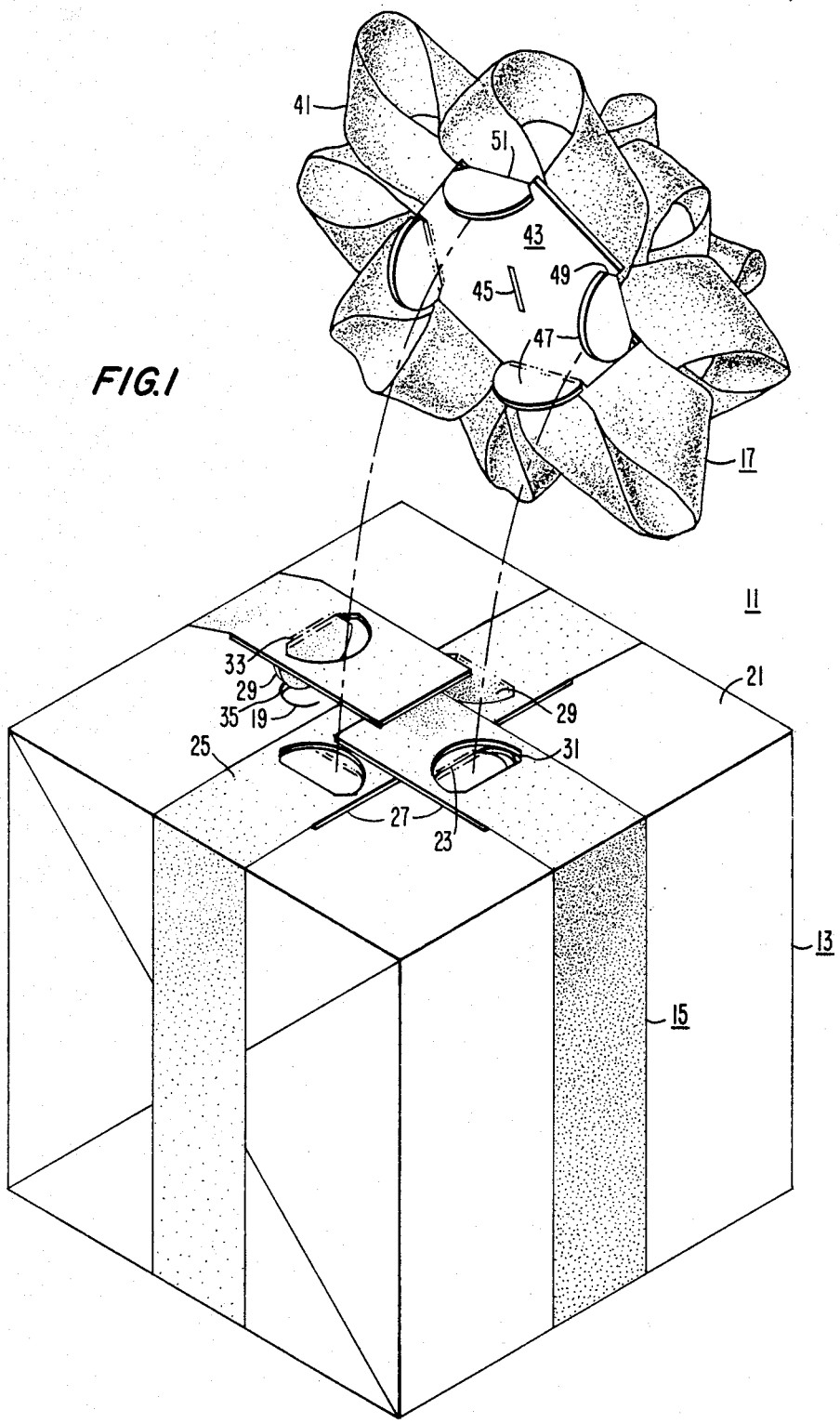
FIG. 1 is an exploded view in isometric showing a gift-wrapping assembly in accordance with this invention.

The apparatus shown in the drawings is gift-wrapping assembly 11 (FIG. 1). The assembly 11 includes a box 13, a plurality of ribbon units 15 looped around the box and a bow unit 17 secured to the top of the box. As shown in FIG. 1, the box 13 has the shape of a cube. The outer surface of the box is decorative.

The box 13 has pairs of oppositely disposed slots 19 in its top 21 (FIG. 1). Each slot 19 is of elongated oval shape and is formed by partial cut-outs or knock-outs die cut in the top. FIG. 2 shows the top 21 of the box die cut with the cut-out flaps 23 flush with the surface of the top prior to bending. In this state, the die cut structure is more appropriately referred to as a slit rather than a slot. The boundary of each slot has the shape of a C as shown in FIG. 2 with the open part of the C closed by a joint 24 about which the cut-out part 23 (FIG. 7) of the slot is hinged. On insertion of a tab 29 into the slot 19, the cut-out part is bent downwardly forming a tongue at an obtuse angle to the inner surface of the box.

Figure 3:
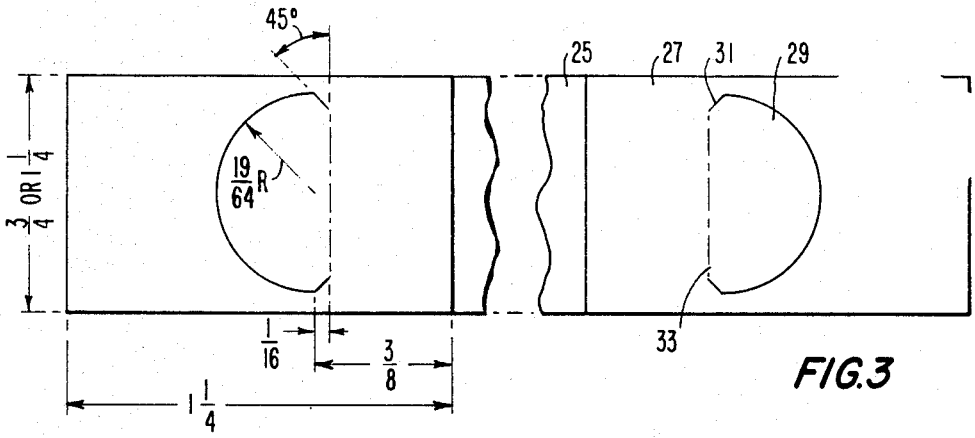
FIG. 3 is a plan view of a ribbon unit of the assembly of FIG. 1 as die cut and prior to bending.
Figure 5:
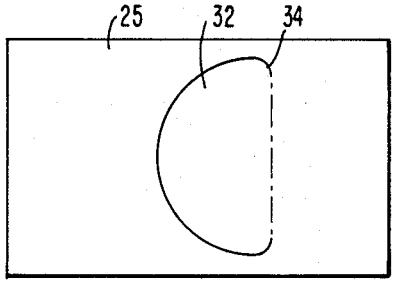
FIG. 5 is a plan view showing a modification of the tabs shown in FIGS. 3 and 4 as die cut and prior to bending.

The ribbon unit 15 includes a ribbon 25 having sheets or plates 27 of plastic secured near its ends. Typically, the plates 27 may have a thickness of about 0.010-inch and may be composed of polyvinyl chloride. The ribbon 25 may have a thickness of 0.005-inch typically. Each plate 27 is overlain with a layer of ribbon 25 which is adhered to the plate (FIG. 7). A tab 29 extends from each plate 27. The tab 29 is die cut into the plate and typically is bent so that it extends approximately at right angles (FIG. 7) to the plate at its junction with the plate. The tab 29 may also be reentrant and at an acute angle to the plate. The die produces a crease along each joint between the tab and the plate which is represented by a broken line in FIG. 3. As shown in FIG. 3, the contour of each tab is typically a semi-circle terminating at each end with an undercut 31 at an angle of about 135° to the junction 33 of the tab and the plate. In the tabs 29 shown in FIG. 3, the contour of the undercut 31 is linear. FIG. 5 shows a tab 32 whose undercut 34 has an arcuate contour.

Figure 8:
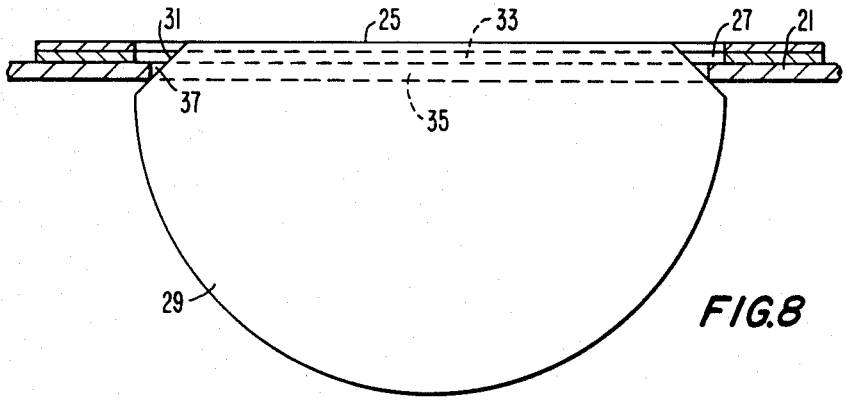
FIG. 8 is a view in section taken along line VIII—VIII of FIG. 7.

The ribbon unit 15 is secured to the box 13 by engagement of the tabs 29 in the slots 19 (FIG. 1). As stated, the die cuts slits in the top 21 of the box 13 with the cut-out portions flush with the surface of the top. In producing the assembly, the ribbon 25 of the ribbon unit 15 is looped around the box 13 and the junction 33 of each tab 29 is engaged with the outer boundary 35, i.e., the boundary opposite the cut-out portion 23, of the slot 19. The cut-out portion 23 is bent downwardly by the tab forming a tongue which resiliently engages the tab. The corners of the slot, terminating at the boundary 35, are clamped in the V 37 formed between the undercut 31 and the portion of the plate 27 diverging from the inner end of the undercut (FIG. 8). The distance along the ribbon 25 between the junction of each tab and the plate and the opposite junction is such that the ribbon is tightly looped around the box and exerts tension on each plate, so that there is pressure between each junction and the boundary 35 of the slot which it engages and the undercut regions 31 are urged into firm engagement with the corners of the slot. The ribbon unit 15 is thus locked firmly to the box 13. In a typical gift-wrapping assembly, for example, with a cubical box four inches on a side, and with dimensions for the ribbon and slots as shown in FIGS. 2 and 3, the distance between the edges of the slots 19 where the ribbon is engaged is about 14-½ inches and the distance between the engaging edges of the tabs 29 along the ribbon is about 14-½ inches.

Figure 4:
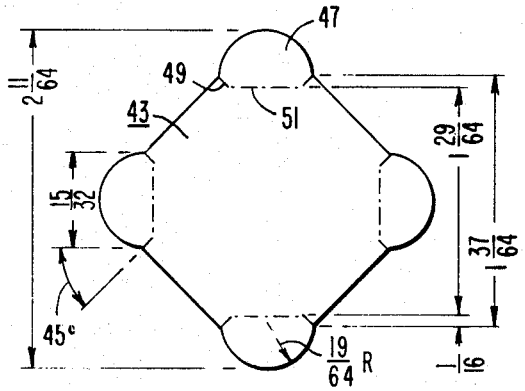
FIG. 4 is a plan view of a plate having tabs secured to the bow of the bow unit of the assembly of FIG. 1 as die cut and prior to bending and as seen in the direction towards the side of the plate outwardly of the bow; i.e., in the direction away from the top of the box with reference to FIG. 1.

The bow unit 17 (FIG. 1) includes a bow, rosette or pompom 41 to the bottom of which a plate 43 is secured by a staple 45. Typically, the plate 43 is square. Tabs 47 are bent outwardly from its corners. In FIG. 4 the tabs 47 are shown prior to bending. The contour of each tab 47 includes a semi-circular portion terminating in linear undercuts 49 extending to the junction 51 of the tab 47 and the plate 43. The undercut may be of arcuate contour similar to the undercut 34 of the tab 32 (FIG. 5) instead of linear. The plate 43 and the tabs 47 are so dimensioned and the tabs are so oriented that the bow unit 17 may be mounted on the box 13 with the tabs 47 extending into the slots 19 and overlaying the tabs 29 of the ribbon units 15. The junction 51 of each tab 47 extends along, and in engagement with, the junctions 33 of the contiguous tab 29. The corner of each slot is engaged by the V-groove overlaying the V-groove 37 between the undercut 49 and the plate 43 and the bow unit is thus locked into the slots. Typically, each tab 29 should extend downwardly into the slot 19 at approximately 90° to its plate 27 and each tab 47 should extend downwardly into slot 19 at approximately 90° to its plate 43. Each tab 47 when positioned in its slot 19 is engaged by the tongue 23 in the slot. The spacing between the joints 51 of the opposite tabs 47 is so related to the spacing between boundaries 35 of opposite slots 19 (see FIGS. 2, 3, 4) that, when superimposed on the tabs 29 of the ribbons 25, the tabs 47 exert pressure outwardly in opposite directions, locking the bow and the ribbon on the box. To assure effective locking of the bow and ribbon to the box, it may be necessary to set the nominal dimensions so that in the distance between the joints 51 of opposite tabs 47 as slightly greater than the distance between opposite boundaries 35.

FIG. 10 shows a gift-wrapping assembly 61 in which the box 63 has the shape of a rectangular parallelapiped of relatively low height. This assembly is in other respects similar to the assembly 11 shown in FIG. 1. FIGS. 8 through 12 of Fonas application '729 discloses such a box, except for the slots which would be provided in top 52 of FIG. 6.

While preferred embodiments of this invention has been disclosed herein, many modifications thereof are feasible. This invention is not to be restricted except insofar as is necessitated by the spirit of the prior art.

I claim:

1. In a gift-wrapping assembly a ribbon unit having ends and being composed of a stiff material at least along a portion of its length near said ends, said ribbon unit having tabs cut out of the stiff material, each tab being near, but spaced from, the corresponding end of said ribbon unit, each said tab forming a junction with said stiff material and being hinged along said junction.

2. The ribbon unit of claim 1 which includes a decorative ribbon having ends and wherein the stiff material extending at least along a portion of the length of said ribbon unit are plates connected to said ends.

3. The unit of claim 2 wherein the tab is undercut at each end of its junction with the plate.

4. The ribbon unit of claim 1 wherein the tab is undercut contiguous to each end of its junction with the stiff material.

5. An assembly for gift-wrapping including a box having a plurality of slots, a ribbon unit including a decorative ribbon having ends and having tabs near said ends, each tab forming a junction with the ribbon, said ribbon encircling said box and being secured to said box by the engagement of said tabs in said slots, and a bow unit including a decorative bow having at least one tab extending from said bow and forming a junction with said bow unit, said bow unit being mounted on said box by the engagement of said at least one tab with a said slot in said box.

6. The assembly of claim 5 wherein plates are secured to the ribbon of the ribbon unit near its ends and the tabs are produced by cut-outs in said plates, each said cut-out producing a slot in the plate from one boundary of which slot the associated tab is hinged, and wherein the slots in the wall of the box are oppositely disposed, the ribbon unit encircling the box with the ribbon unit secured by the engagement in the oppositely disposed slots in said wall of said box with the slots in the plate generally coincident with the slots in the box, the bow unit being mounted on the box with the tab in the bow in engagement with at least one set of said coincident slots overlying the tab produced by said cut-out in the one plate in said at least one set of coincident slots which coincident slots include a slot in said one plate coincident with a slot in said box.

7. The assembly of claim 5 wherein the tabs of the ribbon unit and of the bow unit are each undercut at its ends which are contiguous to its associated junction and the undercuts are latched in the slots whereby the ribbon unit and the bow unit are firmly held on the box by said latching of the undercuts in said slots in the box.

8. The assembly of claim 5 wherein the tabs of the ribbon are undercut at each end of their respective junctions with the ribbon.

9. The assembly of claim 5 wherein the tab of the bow forms a junction with the bow unit and is undercut at the ends of said junction.

10. The method of producing a gift-wrapping assembly including a box and decorative means, wherein the decorative means includes tabs, the said method including die-cutting slits in a wall of said box, each said slit defining a cut-out portion flush with the wall and hinged about a joint between the cut-out portion and the remainder of the wall, and mounting said decorative means on said wall by engaging each of said tabs with a said cut-out of an associated slit, thereby bending said associated cut out portion into the box to form a slot in which said each tab is engaged with said associated cut-out portions forming a tongue resiliently engaging said each tab.

11. An assembly for gift wrapping including a box, at least one slot in a wall of said box, said slot having opposite boundaries with a tongue extending from one of said opposite boundaries, and a decorative bow unit mounted on said box, said bow unit including a bow having at least one tab extending therefrom, from, said bow unit being mounted on said box by engagement of said tab in said slot, said tab engaging the other of said opposite boundaries and said tongue engaging said tab.

12. An assembly for wrapping a gift including a box, a plurality of slots in a wall of said box and at least one decorative ribbon unit mounted on said box, each of said slots having oppositely disposed boundaries with a tongue extending from one of said oppositely disposed boundaries, said ribbon unit having ends and having tabs near said ends, each of said tabs being engaged with a corresponding one of said slots to mount said ribbon unit on said box, the tab engaging each of said slots engaging the other of said oppositely disposed boundaries of said each of said slots and being held by said tongue, said ribbon unit having a length between said tabs such that when said tabs are engaged in said slots, said ribbon unit encircles said box giving said box a decorative appearance.

13. An assembly for wrapping a gift including a box, a plurality of slots in a wall of said box and at least one decorative ribbon unit mounted on said box, said ribbon unit having ends, a plate connected near each of said ends of said ribbon unit, a tab in each plate formed as a cutout from the corresponding plate at an angle to the corresponding plate, said cutout which constitutes each tab forming a junction with its corresponding plate from which it is a cutout and being hinged to said corresponding plate along said junction between said last-named cutout and said corresponding plate, each of said tabs being engaged with a corresponding one of said slots to mount said ribbon unit on said box, the slot engaged with each said tab having a boundary, each said tab being engaged with its corresponding slot with said junction of said tab with its corresponding plate along and engaging said boundary of said corresponding slot, said ribbon unit having a length between said tabs such that when said tabs are engaged in said slots, said ribbon unit encircles said box giving said box a decorative appearance.

14. The assembly of claim 13 wherein each tab is undercut contiguous to the ends its junction with the plate, the boundary of the slot which is engaged by said junction being interlocked at its ends with the undercut regions of the tab so that the tabs are latched into the slot holding the ribbon unit securely.

15. The assembly of claim 14 wherein each slot has a boundary opposite to the boundary engaged with the junction of each tab, and a tongue extends from said boundary of said each slot, which boundary is opposite to the boundary engaged with said junction of each tab, said tongue resiliently engaging and holding the associated tab.

16. The assembly of claim 14 wherein the boundary of each slot terminates in a corner at each end and the undercut regions of the tab are interlocked with the slots at said each corner.

17. The assembly of claim 16 wherein the corners in which each boundary terminates are of generally circular contour.

* * * * *